United States Patent [19]

Kennedy

[11] Patent Number: 4,852,446

[45] Date of Patent: Aug. 1, 1989

[54] TWO-IN-ONE BANJO TONE RING

[76] Inventor: Davis E. Kennedy, Drawer F, Athens, W. Va. 24712

[21] Appl. No.: 298,690

[22] Filed: Jan. 19, 1989

[51] Int. Cl.[4] ..... G10D 1/10

[52] U.S. Cl. ..... 84/272

[58] Field of Search ..... 84/269–272

[56] References Cited

U.S. PATENT DOCUMENTS 1,248,196 11/1917 Stathopoulo ..... 84/272

1,503,197 7/1924 McDaniel ..... 84/269

*Primary Examiner*—Lawrence R. Franklin

[57] ABSTRACT

The two-in-one banjo tone ring is an improved banjo rim assembly, offering the banjo buyer a choice of a raised head or flat head tone with absoultely no additional investment, a development heretofore unknown in the area of banjo manufacturing. Merely by disassembling the rim assembly, flipping the tone ring one hundred eighty degrees (180°), then reassembling, the banjo is converted from flat head to raised head or vice versa.

5 Claims, 1 Drawing Sheet

Fig. 1
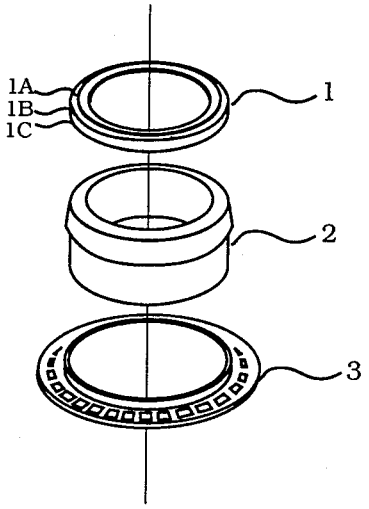
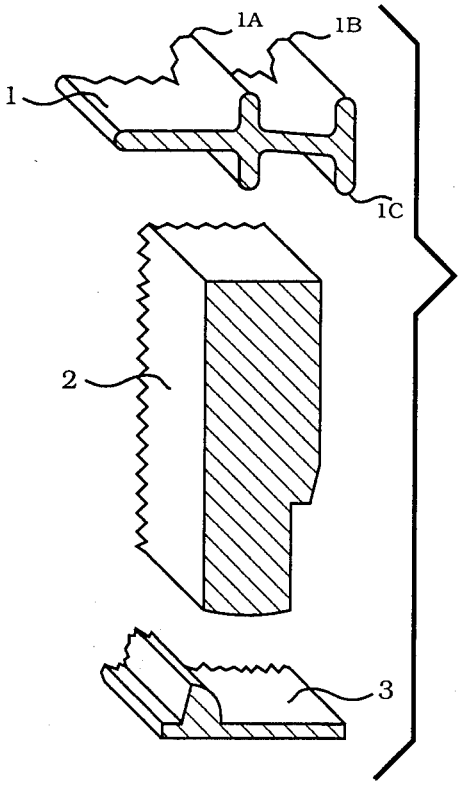
Fig. 2
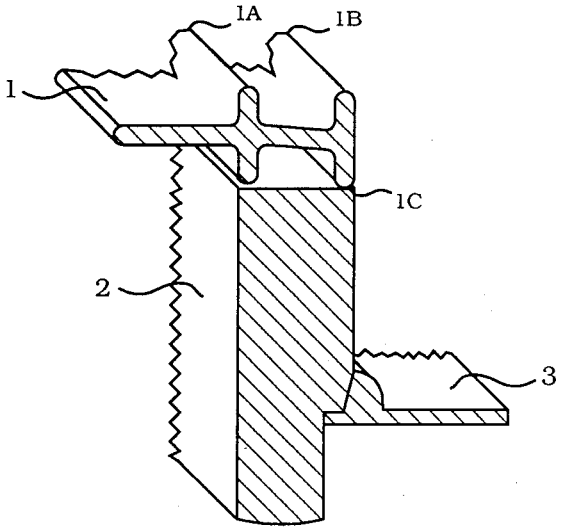
Fig. 3

TWO-IN-ONE BANJO TONE RING

BACKGROUND

1. Field of Invention

This invention relates to the stringed musical instrument popularly known as the banjo.

2. Description of Prior Art

The major components of a banjo rim-assembly (circular part of banjo) are: [1] head (skin or plastic), [2] tone ring (metal), [3] shell (usually wood), and [4] subparts to make the previously mentioned parts into a single taut assembly.

Banjos typically are of two types: [1] raised head (having a tone ring that reduces the main vibrating area of the head to the approximate inside diameter measurement of the shell), and [2] flat head (having a tone ring that maintains the vibrating area of the head to the approximate outside diameter measurement of the shell).

Previously manufactured banjos of quality require a tone ring of a specific design for a raised head and a differently designed tone ring for a flat head. Therefore, if a banjo buyer wanted both a flat head and raised head banjo, he either purchased two banjos or modified a single banjo by purchasing a specially designed tone ring and/or a second shell.

With my two-in-one tone ring installed on a new, original banjo, the owner needs only to disassemble the rim-assembly, flip the two-in-one tone ring one hundred eighty degrees (180°) reassemble, and the alternate type of banjo is in existence with absolutely no cuts or modifications required.

A review of U.S. Patents-class 84/269-272 all inclusive, with particular attention to U.S. Pat. No. 3,677,125; U.S. Pat. No. 3,921,492; U.S. Pat. No. 4,060,018; U.S. Pat. No. 4,226,159; U.S. Pat. No. 4,483,234: All the mentioned patents appear to be cast-/machined tone rings as mine is. No existing patent has the two-in-one feature that may invention has.

DESCRIPTION OF DRAWINGS

In the accompanying drawings, FIG. 1, is an exploded perspective view of the two-in-one tone ring with accompanying parts.

FIG. 2 is a cross-sectional exploded view of the two-in-one tone ring in raised-head position.

FIG. 3 is a cross-sectional view of component in contact with each other and the two-in-one tone ring in raised head position.

DESCRIPTION OF THE PREFERRED EMBODIMENT

The invention is shown in its details in FIGS. 1–3 where like numerals have the same reference in all the drawings. Terms such as "horizontal", "vertical", "upper", "lower", "left", "right", and the like refer to the orientation as seen in the drawings and are not indicative of functions or preferred orientations.

Referring first to FIG. 1, it can be seen that tone ring 1, shell 2, and resonator 3 are all annular bodies which are coaxially aligned when assembled. They are shown in exploded perspective in FIGS. 1 and 2 and in cross-section in FIGS. 2 and 3. Shell 2 and resonator 3 are conventional and are included to show their relationship relative to the tone ring of the invention.

Tone ring 1 is an integral structure having a generally horizontal, plate-like body, said body having an upper and a lower surface and an inner and an outer edge. Two vertical, annular, inner and outer flanges having edges 1A and 1B, respectively, extend in opposite directions from the body. The outer flange is located along the outer edge of the body, and the inner flange is located intermediate the body's two edges. As clearly shown, the flanges are approximately of the same length and are essentially bisected by the plate-like body. The cross-sectional plane defined by the portion of the body inside the inner flange, to the left of edge 1A in FIGS. 2 and 3, forms an obtuse angle with the cross-sectional plane of the portion of the body between the inner and outer flanges. This serves to extend the edge 1A of the inner flange further in one axial direction, upwardly as shown, than the adjacent edge 1B of the outer flange. In like manner, the bottom edge 1C of the outer flange extends further in the opposite axial direction than any other flange edge.

In use, tone ring 1 is adapted to be placed on the top surface of shell 2. In the orientation of tone ring 1 shown in FIG. 3, lower edge 1C rests on the top surface of shell 2, whereas the lower edge of the inner flange opposite edge 1A is spaced therefrom. A banjo head (not shown) is conventionally stretched over the top of tone ring 1 where it contacts the upper edge 1A, slopes downwardly to the right to edge 1B, and then extends down the side of shell 2. Suitable tensioning means (not shown) draws the head taut to its playing tension. The vibrating portion of the head is limited by contact with upper edge 1A, giving the vibrating portion a diameter approximately equal to the inside diameter of shell 2. This forms the aforementioned raised head type banjo structure.

When it is desired to have a flat head type structure, one need only remove the head, flip tone ring 1 over, and replace it on the top of shell 2. In this orientation, not shown, edge 1A would now rest on shell 2 with edge 1B spaced therefrom. Edge 1C would then face upwardly, and, because it is axially the furthest from the banjo shell, it would support the banjo head and define the diameter of the vibrating portion of the head, which diameter would be approximately equal to the outer diameter of shell 2. This forms the flat head type banjo structure.

The foregoing is a description of the currently preferred embodiment and is not intended to define or to limit the invention. The invention is to be limited only by the scope of the following claims.

I claim:

1. A tone ring for a banjo comprising: an annular body;

means on said body for supporting said tone ring on a banjo shell;

first means located on one axial side of said body for defining the vibrating portion of a banjo head to have a diameter approximately equal to the inner diameter of the banjo shell for which the tone ring is intended; and second means located on the other axial side of said body for defining the vibrating portion of a banjo head to have a diameter approximately equal to the outer diameter of said banjo shell, whereby when said tone ring is assembled on said banjo shell with said one side outermost, a raised head type banjo is formed, and when said tone ring is assembled on said banjo shell with said other side outermost, a flat head type banjo is formed.

2. The tone ring of claim 1 wherein said first means is a first annular flange extending away from said body in a first direction, said first flange having a diameter slightly larger than the inside diameter of said banjo shell and said second means is a second annular flange extending away from said body in a second direction opposite from said first direction, said second flange having a diameter slightly less than the outside diameter of said banjo shell.

3. The tone ring of claim 2 wherein said body is formed as an annular plate-like member having opposite surfaces and inner and outer edges, said first and second annular flanges extend approximately equidistantly from both surfaces of said body, said first flange being located intermediate the edges of said body, said second flange being located along said body outer edge, and the portion of said body inside said first flange forming an obtuse angle relative to the portion of said body between said first and second flanges.

4. The tone ring of claim 3 wherein said first flange constitutes said supporting means when said tone ring is in the flat head orientation and said second flange constitutes said supporting means when said tone ring is in the raised head orientation.

5. The tone ring of claim 2 wherein said tone ring is an integral structure made by a casting and/or a machining process.

* * * * *